United States Patent [19]

Jenn-Rong

[11] Patent Number: 5,042,277

[45] Date of Patent: Aug. 27, 1991

[54] PUSH-BUTTON DIGITAL COMBINATION PADLOCK

[76] Inventor: Chern Jenn-Rong, No. 113, Ping Teng Rd., Luh Kang Chen, Chang Hwa Hsien, Taiwan

[21] Appl. No.: 481,622

[22] Filed: Feb. 20, 1990

[51] Int. Cl.[5] ..... E05B 37/02

[52] U.S. Cl. ..... 70/28; 70/23

[58] Field of Search ..... 70/28, 29, 27, 25, 23, 70/42, 43, 44

[56] References Cited

U.S. PATENT DOCUMENTS 4,803,856 2/1989 Ling ..... 70/28

4,860,561 8/1989 Hwang ..... 70/28

*Primary Examiner*—Robert L. Wolfe

*Attorney, Agent, or Firm*—Notaro & Michalos

[57] ABSTRACT

A push-button digital combination padlock including a seat board, a digit-wheel means composed of several digit-wheels, sleeves, wheel shaft, compression spring and elastic plate, a restoring spring, an abutting bar, a movable lock latch and an upper cover associated with the seat board, wherein a frame block is disposed at front end of the wheel shaft, and the movable lock latch is formed with a down-pressing protrusion and passive protrusion, whereby when the digit-wheels are arranged to correct digit position, and shaft can be displaced, permitting a button member of the abutting bar to be pressed so as to push the passive protrusion, making the integrated down-pressing protrusion downward press the frame block and thus permitting the lock bar to move and unlock the padlock.

3 Claims, 6 Drawing Sheets

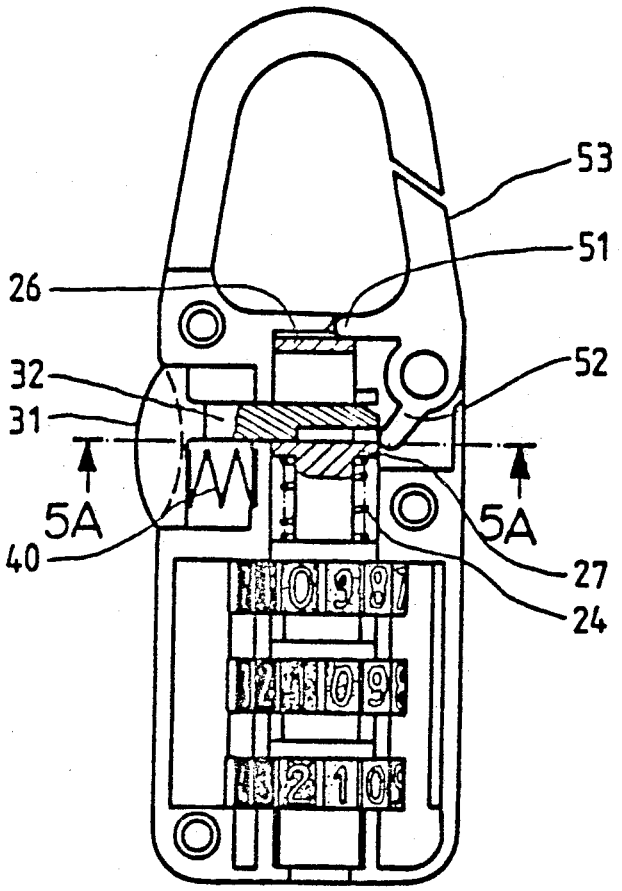
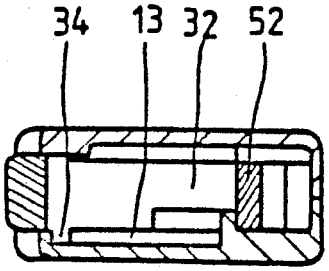
FIG. 5A
FIG. 5

PUSH-BUTTON DIGITAL COMBINATION PADLOCK

BACKGROUND OF THE INVENTION

Nowadays, digital combination padlock appears to be a widely used lock set, and a type of the padlock the lock bar of which can be swung to unlock the padlock is newly developed, as shown in FIG. 1. This type of padlock indeed eliminates the shortcomings existing in early padlock with retractile lock bar. However, still some drawbacks exist in such padlock as follows:

(1) The digit-wheels, sleeve, spring, lock hook and lock bar are all positioned in the same plane in the lock cover, and especially, the projections of an elastic slide pin must be inserted into cuts in the sleeve of the lock, thus making the assembly of the padlock not so easy and much working time is wasted. Moreover, poor quality is often caused due to difficult assembly.

(2) When locking or unlocking the padlock, one must move forward or backward the movable lock bar with his finger, as shown in FIG. 2, and obstruction or even finger injury caused by striking takes place frequently.

(3) The padlock is composed of many complex components, and especially, the elastic slide pin and movable lock bar are manufactured at high material and working time comsumption. Also, the mold thereof can not be easily made, therefore, increasing the manufacturing cost.

SUMMARY OF THE INVENTION

The applicant has therefore developed the present invention to eliminate the above-mentioned shortcomings existing in prior art.

Accordingly, it is a primary object of the present invention to provide a push-button digital combination padlock including a housing, a digit-wheel means composed of several digit-wheels, sleeves, wheel shaft, compression spring and elastic plate, a restoring spring, an abutting bar, a movable lock latch, and an upper cover associated with the housing. A frame block having a frame hole is disposed at an end of the wheel shaft, and the abutting bar has a rectangular rod extending through the frame hole, while the movable lock bar is formed with a down-pressing protrusion for downward pressing the frame block. A passive protrusion opposed against the rectangular rod, a lock bar and a through hole, are also included whereby when the digit-wheels are arranged to the correct digit position, the wheel shaft can be displaced, permitting the button member to be pressed so as to urge the rectangular rod to push the passive protrusion, making the integrated down-pressing protrusion downward press the frame block and wheel shaft so that the lock bar can be moved away from the lock hook to unlock the padlock. When the botton member is released and the abutting bar is restored to its original position by the restoring spring, the lock bar will also return to its original position to lock the padlock. According to the above arrangement, the padlock of this invention can be operated via pressing the button member without using a finger to swing the lock bar, and thus the possible injury can be avoided. Also, the design and assembley of parts are facilitated to greatly lower manufacturing cost and promote quality.

The present invention can be best understood through the following description with reference to the accompanying drawings wherein:

BRIEF DESCRIPTION OF THE DRAWINGS

FIG. 1 (B) is a view like FIG. 1 (B), in an unlocked position;

FIG. 5 shows a locking state thereof;

FIG. 5A is a sectional view taken along line 5A—5A of FIG. 5; and

DETAILED DESCRIPTION OF THE PREFERRED EMBODIMENT

Figure 1A:
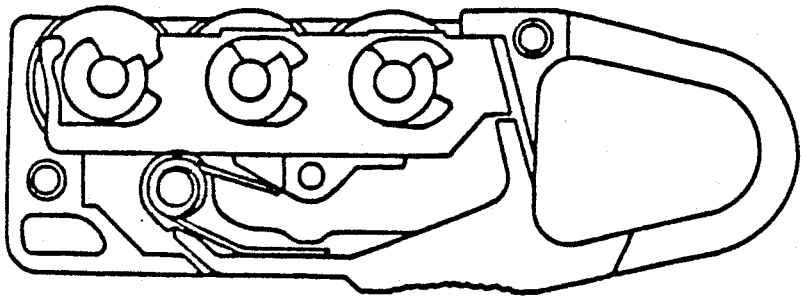
FIG 1(A) (PRIOR ART)
FIG. 1 (A) is a longitudinal sectional view of a conventional digital combination padlock in a locked position.
Figure 1B:
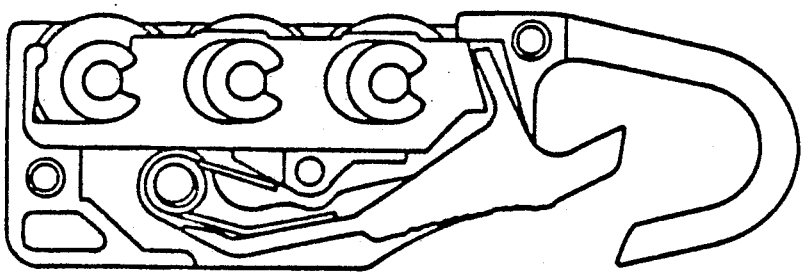
FIG. 1(B) (PRIOR ART)
Figure 2:
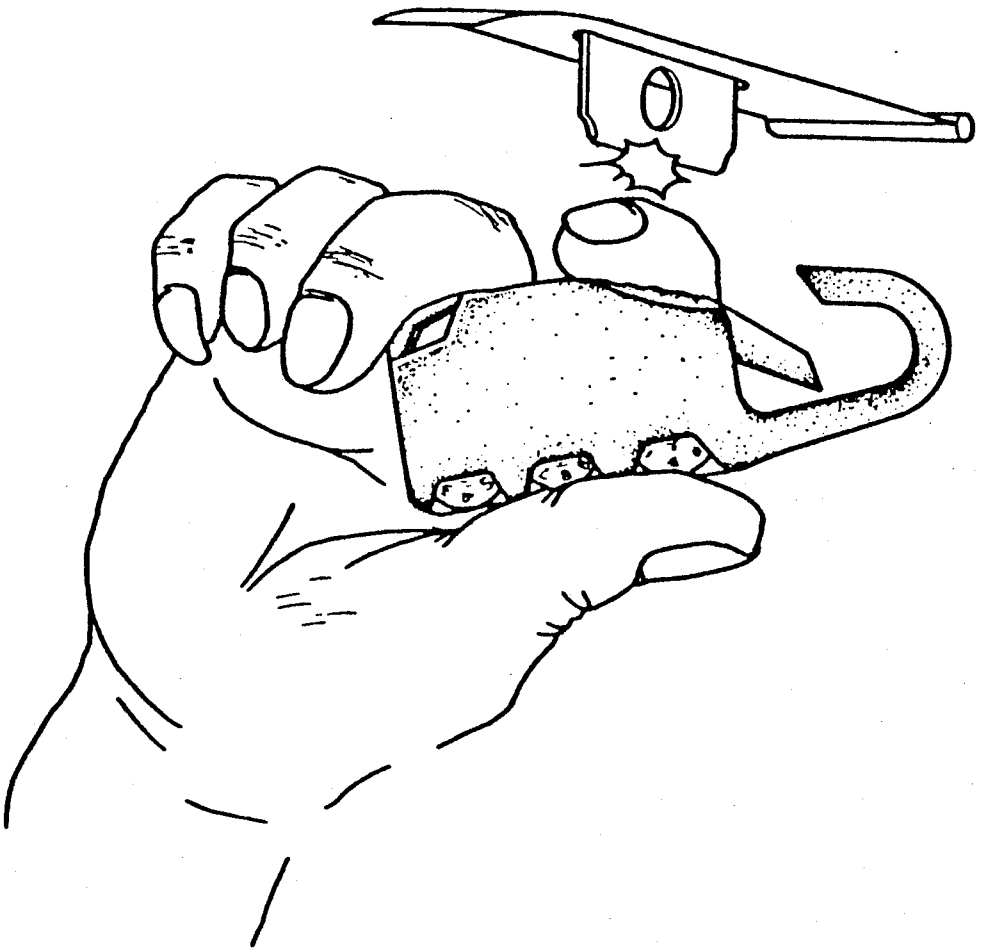
FIG. 2 (PRIOR ART)
FIG. 2 shows the operation of a conventional digital combination padlock.
Figure 3:
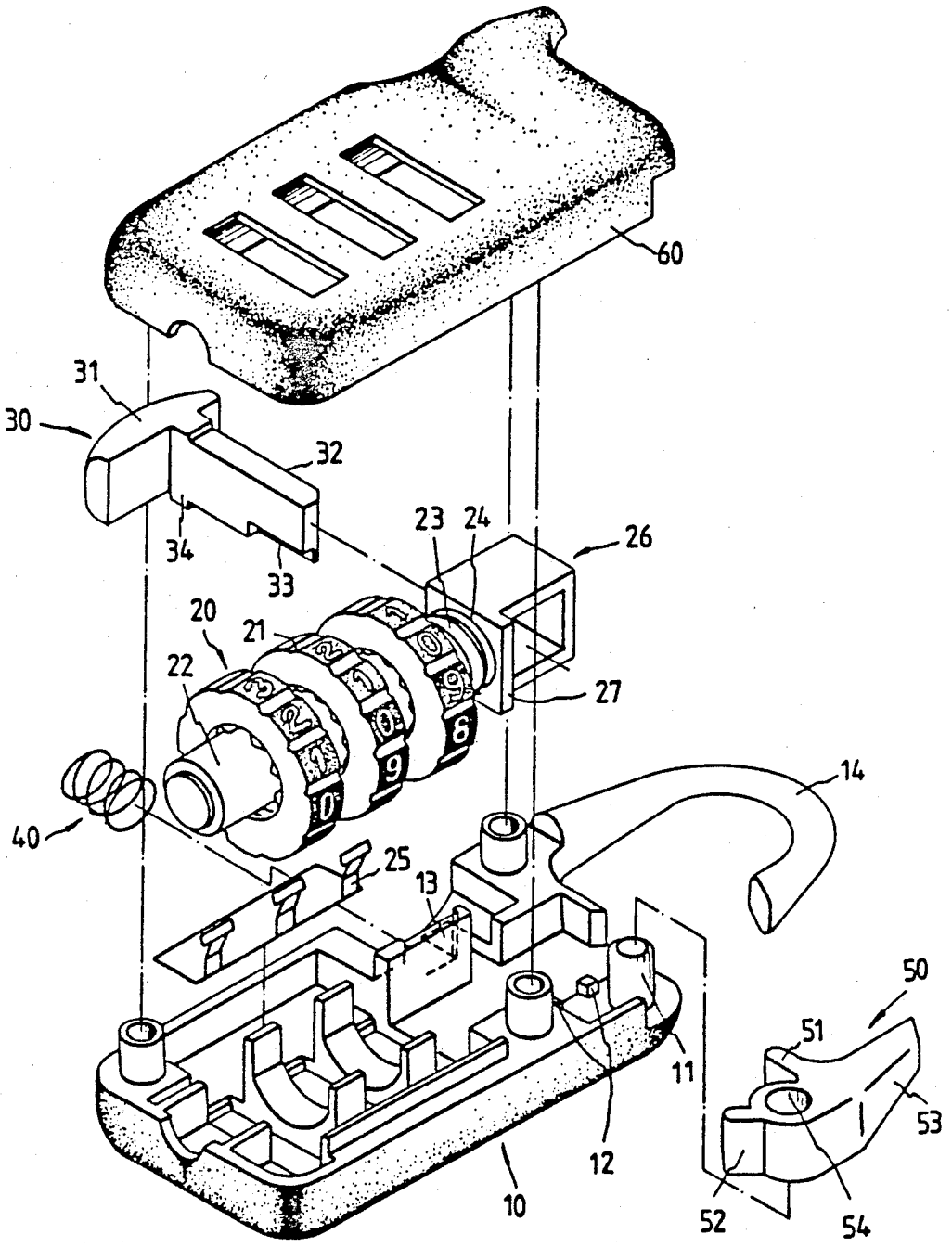
FIG. 3 is an exploded view of the present invention.

Please refer to FIG. 3. The push-button digital combination padlock of this invention includes: a housing 10 formed with a shaft projection 11, protuberances 12, recess 13 and a lock hook 14 integrally formed at one end of the housing 10. A digit-wheel means 20 having several digit-wheel 21, a sleeve 22, wheel shaft 23, compression spring 24 and elastic plate 25 are mounted in the housing 10. Wheels 21 are rotatable around the axis of shaft 23. A frame block 26 having a frame hole is disposed at one end of the wheel shaft 23, the frame block 26 further having a laterally extending edge 27 near the wheel shaft 23. An abutting bar 30 has one end formed with a button member 31 and an opposite end formed with a rectangular rod 32 having a lower slide depression 33 for slidably engaging with the protuberances 12 and lower protrusion 34 for fitting in the recess 13 of housing 10 so as to prevent abutting bar 30 from slipping out of the housing 10. A restoring spring 40 is disposed in the housing 10 with one end opposed against the inner face of the button member 31 and an opposite end resting against housing 10. A movable lock latch 50 is formed with a down-pressing or locking protrusion 51, a passive protrusion 52, a lock bar 53 and a through hole 54, wherein the through hole 54 receives the shaft projection 11 of seat board 10, making the lock bar 53 match with the lock hook 14 to form a lock ring; and an upper cover 60 su table to be associated with the seat board 10 to form a lock body.

The digit-wheel means 20 is disposed in the seat board 10 with the extending edge 27 of frame block 26 restricted between protuberances 12, preventing the wheel shaft 23 from slipping out of the seat board 10. The abutting bar 30 is disposed through frame hole of the frame block 26 with its button member 31 exposed outside lateral side of the seat board 10 and its protrusion 34 restricted in recess 13 thereof, as shown in FIG. 5, to avoid slipping of the abutting bar 30 away from the seat board 10 and fix the abutting bar 30 thereon. By means of the elastic force of the restoring spring 40, the rectangular rod 32 can move back and forth via pressing the button member 31, while the movable lock latch 50 is fitted on shaft projection 11 with the same received in the through hole 54 so that the passive protrusion 52 is pressed by the rectangular rod 32 and down-pressing protrusion 51 is pressed against the frame block 26, making the lock bar 53 to match with lock hook 14. he upper cover 60 can be then affixed to the housing 10 to accomplish the present invention.

Figure 4:
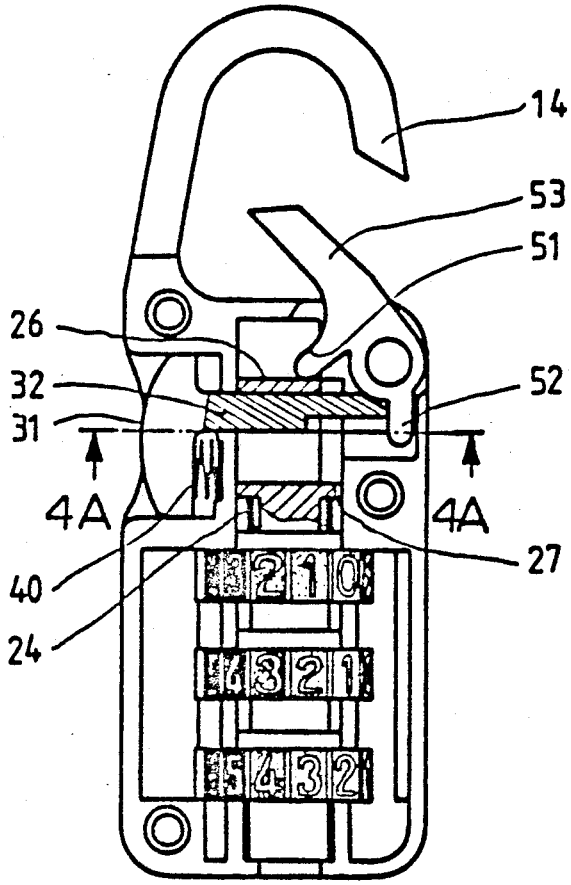
FIG. 4 shows an unlocking state thereof.
Figure 4A:
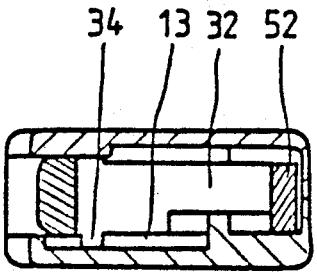
FIG. 4A is a sectional view taken along line 4A—4A of FIG. 4.
Figure 6:
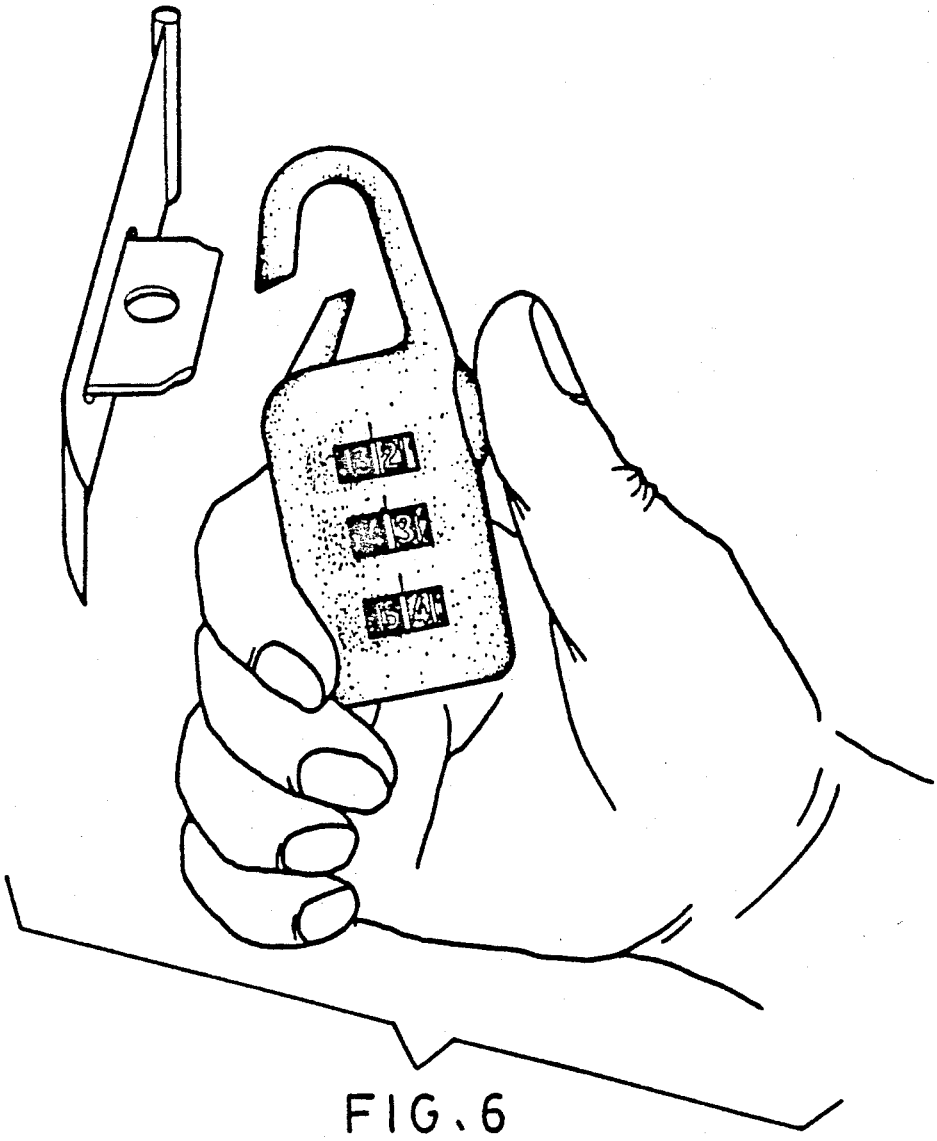
FIG. 6 shows the operation of the present invention.

The digit-wheel means 20 operates by rotating the plurality of digit-wheels 21 around wheelshaft 23 which is held against rotation by frame block 26, until a preset digit position is achieved which allows shaft 23 to move axially in housing 10 for lowering frame block 26 into the position shown in FIG. 4.

When unlocking the present invention, as shown in FIG. 4, the digit-wheels are rotated to preset digit position with the wheel shaft 23 movable axially. In this position, the button member 31 can be pressed to move the rectangular rod 32 to the right for pushing the passive protrusion 52 so that the movable lock latch 50 rotates about the shaft projection 11 whereby the down-pressing protrusion 51 accordingly presses the frame block 26 downwardly. (Since at this time, the digit-wheels have been arranged to preset digit position, therefore the frame block 26 can be pressed down.) Following the down-pressing protrusion 51, the lock bar 53 moves away from the lock hook 14 to form the unlocking state. Thereby, when unlocking the present invention, one only needs to set the digit-wheels to correct position and then press the button member on the lateral side of lock body so as to open the lock bar and remove the lock body, as shown in FIG. 4. As a result, the shortcomings existing in the prior art that one must drive the lock bar with his finger and obstruction or even striking and injury may occur.

When locking the present invention, as shown in FIG. 5, the button member is released and restored to its original position by restoring spring 40. At this time, the passive protrusion 52 is free from pushing force and the downward pressing force of the locking down-pressing protrusion 51 disappears, permitting the frame the frame block 26 to be returned to its original position by the compressing spring 24. Consequently, the down-pressing protrusion 51 is raised by the frame block 26 to go back to its original position, and similarly to the unlocking operation, the movable lock latch 50 will rotate about the shaft projection 11 to restore the passive protrusion 52 to its original position. Simultaneously, the lock bar 53 is retreated to match with the lock hook 14. One can thereafter randomly rotate the digit-wheels to lock the lock body.

I claim:

1. A digital combination padlock comprising:

a housing (10);

digit-wheel means (20) mounted in said housing and comprising a wheel shaft (23) mounted for axial movement in said housing between a locked position and an unlocked position, a plurality of sleeves (22) and digit-wheels (21) mounted for rotation on said wheel shaft and held against axial movement in said housing for rotation to a preset digit position for permitting axial movement of said wheel shaft and a compression spring (23) engaged with said shaft for biasing said shaft toward said locked position;

a frame block (26) connected to said shaft and movable axially in said housing with said shaft between said locked and unlocked positions, said frame block having a frame hole therein extending transversely to a direction of axial movement of said frame block in said housing;

a lock hook (14) fixed to said housing;

a lock latch (50) pivotally connected to said housing for movement between a locked position forming a closed loop with said lock hook and an unlocked position whereat said latch is pivoted inwardly of said loop to open said loop, said lock latch having a locking protrusion (51) engagable by said frame block with said frame block in said locked position for holding said latch in the locked position of said latch, said latch including a passive protrusion (52) spaced from said locking protrusion;

an abutment bar (30) having a rectangular rod (32) movable in said frame hole of said frame block into and out of engagement with said passive protrusion for engaging said passive protrusion to rotate said latch into the unlocked position of said latch, said abutting bar including a button member (31) connected to one end of said rectangular rod spaced away from said latch for manually sliding said rectangular rod toward said latch;

a restoring spring (40) engaged between said button member and said housing for moving said rectangle rod away from and out of engagement with said passive protrusion for allowing free rotation of said latch between its locked and unlocked positions;

said lock hook having a base fixed to one side of said housing and a hook portion extending around toward an opposite side of said housing, said latch being pivotally mounted at said opposite side of said housing, said button member being positioned at said one side of said housing with said rectangular rod extending to said opposite side of said housing;

guide means (12, 33) in said housing for guiding the sliding movement of said rectangular rod;

retaining means (13, 34) in said housing for retaining said abutment bar in said housing; and a cover (60) connected to said housing and covering said digit-wheel means, said frame block, said compression spring, said restoring spring and said abutment bar.

2. A padlock according to claim 1, wherein said guide means comprises protrusions (12) in said housing extending toward said cover and a slide depression (33) in said rectangular rod slidably engaged along one of said protrusions, said retaining means comprising a recess (13) in said housing and a lower protrusion (34) in said rectangular rod engageable in said recess for precluding removal of said abutment bar from said housing.

3. A padlock according to claim 2, wherein said housing includes a shaft projection (11) at said one side thereof, said latch (50) including a hole (54) therethrough for receiving said shaft projection to pivotally mount said latch to said housing.

* * * * *